US007407251B2

(12) United States Patent
Akase

(10) Patent No.: US 7,407,251 B2
(45) Date of Patent: Aug. 5, 2008

(54) PRINTING METHOD, COMPUTER-READABLE MEDIUM, PRINTING APPARATUS, PRINTING SYSTEM, AND PATTERN FOR CORRECTION

(75) Inventor: Takashi Akase, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 236 days.

(21) Appl. No.: 10/817,153

(22) Filed: Apr. 5, 2004

(65) Prior Publication Data

US 2005/0001867 A1 Jan. 6, 2005

(30) Foreign Application Priority Data

Apr. 4, 2003 (JP) ..... 2003-101852
Apr. 1, 2004 (JP) ..... 2004-108825

(51) Int. Cl.
*B41J 29/393* (2006.01)
*B41J 29/38* (2006.01)

(52) U.S. Cl. ..... 347/19; 347/16

(58) Field of Classification Search ..... 347/16, 347/19

See application file for complete search history.

(56) References Cited

U.S. PATENT DOCUMENTS 6,082,911 A * 7/2000 Murakami ..... 400/74
6,637,853 B1 * 10/2003 Ahne et al. ..... 347/19

FOREIGN PATENT DOCUMENTS

JP 07-097098 A 4/1995

* cited by examiner

*Primary Examiner*—Julian D. Huffman
*Assistant Examiner*—Jason S Uhlenhake
(74) *Attorney, Agent, or Firm*—Sughrue Mion, PLLC

(57) ABSTRACT

Reliable and quick adjustment of, for example, a print start position is achieved through accurate recognition of the positional relationship between a medium and a reference position used when printing. As regards performing printing by forming dots on a medium using a movable print head, the print head is moved by a first set amount from a reference position used when printing and it prints a first reference pattern on the medium, a position of an edge of the medium on the reference position side in the direction of movement of the print head is detected, and the print head is moved to a position that is apart by a second set amount from the position of the edge that has been detected and it prints a second reference pattern.

12 Claims, 8 Drawing Sheets

PRINTING METHOD, COMPUTER-READABLE MEDIUM, PRINTING APPARATUS, PRINTING SYSTEM, AND PATTERN FOR CORRECTION

CROSS-REFERENCE TO RELATED APPLICATIONS

The present application claims priority upon Japanese Patent Application No. 2003-101852 filed on Apr. 4, 2003 and Japanese Patent Application No. 2004-108825 filed on Apr. 1, 2004, which are herein incorporated by reference.

BACKGROUND OF THE INVENTION

1. Field of the Invention

The present invention relates to printing methods, computer-readable media, printing apparatuses, printing systems, and patterns for correction.

2. Description of the Related Art

So-called serial printers print desired patterns (for example, figures or characters) by applying pressure to liquid ink to eject the liquid ink from nozzles, or sublimating solid-state ink, to form dots on a medium.

Media (such as print paper) of various sizes are used in serial printers, and thus it is necessary to adjust the print position (print range) according to the size of the medium. Conventionally, various methods for this have been proposed.

Incidentally, with serial printers, various patterns are printed as print heads are scanned in a main-scanning direction and the medium is moved in the sub-scanning direction by a paper feed roller. As for the print start position in the main-scanning direction, a position that is apart from a reference position (the so-called "mechanical reference position"), which serves as a reference, by a predetermined distance (normally, the position corresponding to an edge of the print member) is taken as the print start position.

Therefore, if the reference position mentioned above is deviated from the set position on the design, then deviation occurs in the print start position in the main-scanning direction.

SUMMARY OF THE INVENTION

The present invention was arrived at based on the foregoing matters, and it is an object thereof to provide a printing method, a computer-readable medium, a printing apparatus, a printing system, and a pattern for correction with which it is possible to recognize the positional relationship (such as deviation) between a reference position used when printing and a medium.

A primary aspect of the present invention is a printing method such as the following.

A printing method for printing by forming dots on a medium using a movable print head, comprises:

a step of moving the print head by a first set amount from a reference position used when printing and printing a first reference pattern on the medium;

a step of detecting a position of an edge of the medium on the reference position side in the direction of movement of the print head; and a step of moving the print head to a position that is apart by a second set amount from the position of the edge that has been detected and printing a second reference pattern.

Further, another primary aspect of the present invention is a computer-readable medium such as the following.

A computer-readable medium comprises the following codes:

a code for moving a movable print head by a first set amount from a reference position used when printing and printing a first reference pattern on the medium;

a code for detecting a position of an edge of the medium on the reference position side in the direction of movement of the print head; and a code for moving the print head to a position that is apart by a second set amount from the position of the edge that has been detected and printing a second reference pattern.

Further, another primary aspect of the present invention is a printing apparatus such as the following.

A printing apparatus comprises:

a movable print head for performing printing by forming dots on a medium;

a sensor for detecting an edge of the medium; and a controller for controlling operation of the print head and the sensor;

wherein the controller causes:

the print head to move by a first set amount from a reference position used when printing and print a first reference pattern on the medium;

the sensor to detect a position of an edge of the medium on the reference position side in the direction of movement of the print head; and the print head to move to a position that is apart by a second set amount from the position of the edge that has been detected and print a second reference pattern.

Further, another primary aspect of the present invention is a printing system such as the following.

A printing system comprises:

a printing apparatus; and a computer that is capable of communicating with the printing apparatus;

wherein the printing apparatus includes:

a movable print head for performing printing by forming dots on a medium;

a sensor for detecting an edge of the medium; and a controller for controlling operation of the print head and the sensor; and wherein the controller causes:

the print head to move by a first set amount from a reference position used when printing and print a first reference pattern on the medium;

the sensor to detect a position of an edge of the medium on the reference position side in the direction of movement of the print head; and the print head to move to a position that is apart by a second set amount from the position of the edge that has been detected and print a second reference pattern.

Further, another primary aspect of the present invention is a pattern for correction such as the following.

A pattern for correction, which is used with a printing apparatus for printing by forming dots on a medium using a movable print head and which is for setting a print start position of the print head, comprises:

a first reference pattern that is printed by the print head after the print head has been moved by a first set amount from a reference position used when printing; and a second reference pattern that is printed by the print head after the print head has been moved to a position that is apart by a second set amount from a position of an edge of the medium on the reference position side in the direction of movement of the print head.

A yet further primary aspect of the present invention is a printing apparatus such as the following.

A printing apparatus for printing target information on a medium by ejecting or sublimating ink to form dots, comprises:

first reference pattern printing means for printing a first reference pattern at a position on the medium that is apart by a predetermined set amount, in a main scanning direction, from a reference position used when printing;

detecting means for detecting an edge of the medium on the reference position side;

second reference pattern printing means for printing a second reference pattern at a position that is apart by a predetermined set amount using the edge that has been detected by the detecting means as a reference; and print start position correcting means for printing either one of the first or second reference pattern while suitably changing its set amount to correct a print start position in accordance with a correction amount that is determined according to a relationship between the first and second reference patterns.

Other features of the present invention will become clear through the accompanying drawings and the following description.

BRIEF DESCRIPTION OF THE DRAWINGS

In order to facilitate a more complete understanding of the present invention and the advantages thereof, reference is now made to the following description taken in conjunction with the accompanying drawings.

DETAILED DESCRIPTION OF PREFERRED EMBODIMENTS

Figure 1:
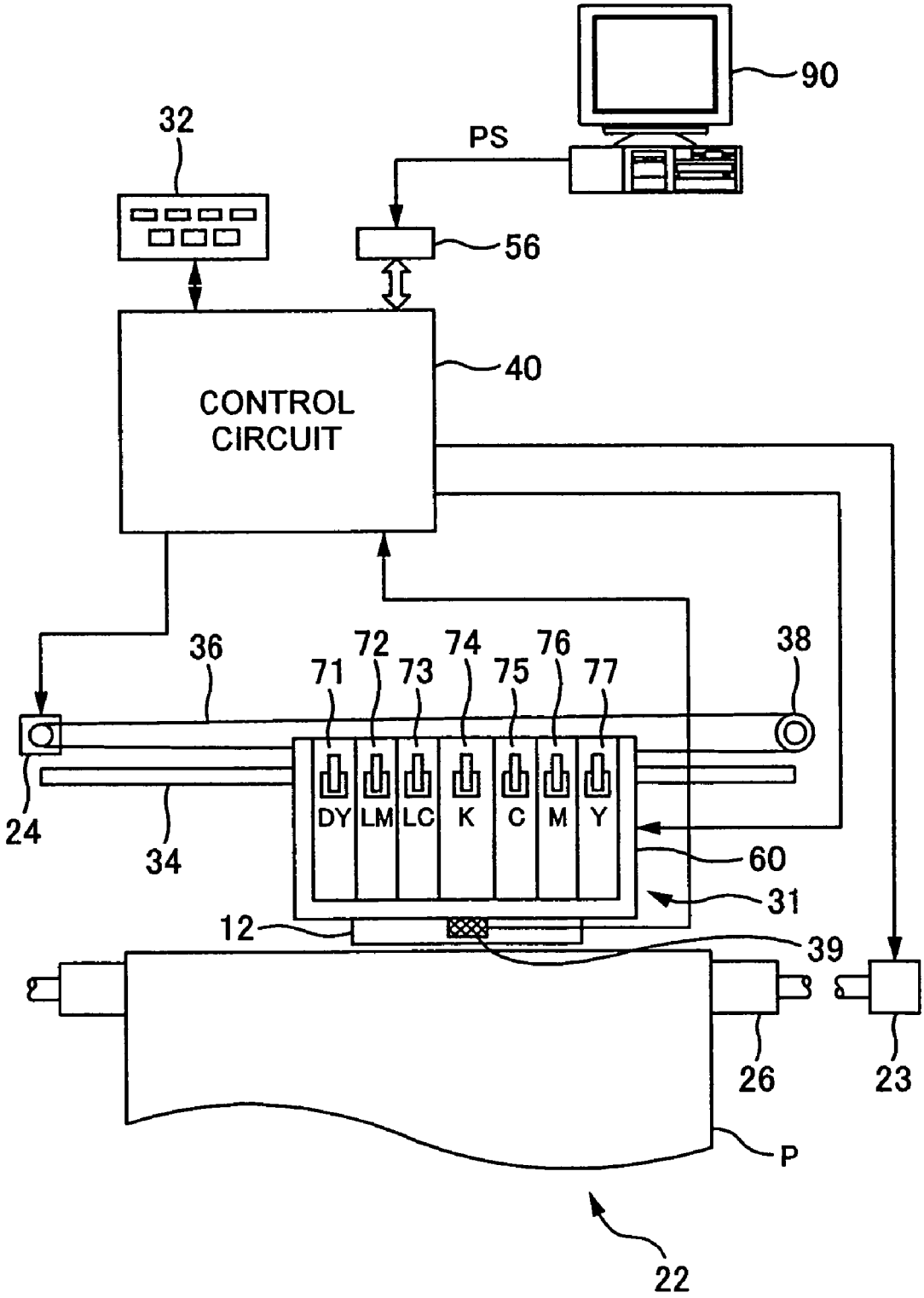
FIG. 1 is a diagram schematically showing the configuration of a printer and a computer system for printing according to the present embodiment.

At least the following matters will be made clear by the present specification and the accompanying drawings.

A printing method for printing by forming dots on a medium using a movable print head, comprises:

a step of moving the print head by a first set amount from a reference position used when printing and printing a first reference pattern on the medium;

a step of detecting a position of an edge of the medium on the reference position side in the direction of movement of the print head; and a step of moving the print head to a position that is apart by a second set amount from the position of the edge that has been detected and printing a second reference pattern.

Thus, it is possible to recognize the positional relationship between the reference position used when printing and the medium.

Further, either one of the first reference pattern or the second reference pattern may be printed while suitably changing either one of the first set amount or the second set amount. Thus, the print start position can be reliably and quickly adjusted.

Further, the print head may print target information on the medium by forming dots by ejecting or sublimating ink; and a print start position of the print head may be corrected in accordance with a correction amount that is determined according to a relationship between the first reference pattern and the second reference pattern. Thus, the print start position can be reliably and quickly corrected.

Further, of the first reference pattern and the second reference pattern, the reference pattern that is printed while suitably changing either one of the first set amount or the second set amount may have a plurality of line segments with different positions on the medium. Thus, the optimal set amount for the print start position can be easily and quickly obtained.

Further, the print start position may be corrected in accordance with a set amount of a line segment, among the plurality of line segments, that is closest to the other reference pattern. Thus, the print start position can be calibrated quickly according to the optimal set amount.

Further, one or more line segments, among the lines configuring the plurality of line segments, may be printed in a single movement of the print head. Thus, it is possible to quickly print the pattern for correction.

Further, an edge of the medium may be detected by an optical sensor; and the print head may print the second reference line using the edge of the medium that has been detected by the optical sensor as a reference. Thus, the second reference pattern can be accurately and quickly printed without being affected by the magnetic noise that is generated by the motor of the drive system, for example.

It is also possible to achieve a computer-readable medium such as the following.

A computer-readable medium comprises the following codes:

a code for moving a movable print head by a first set amount from a reference position used when printing and printing a first reference pattern on the medium;

a code for detecting a position of an edge of the medium on the reference position side in the direction of movement of the print head; and a code for moving the print head to a position that is apart by a second set amount from the position of the edge that has been detected and printing a second reference pattern.

It is also possible to achieve a printing apparatus such as the following.

A printing apparatus comprises:

a movable print head for performing printing by forming dots on a medium;

a sensor for detecting an edge of the medium; and a controller for controlling operation of the print head and the sensor;

wherein the controller causes:

the print head to move by a first set amount from a reference position used when printing and print a first reference pattern on the medium;

the sensor to detect a position of an edge of the medium on the reference position side in the direction of movement of the print head; and the print head to move to a position that is apart by a second set amount from the position of the edge that has been detected and print a second reference pattern.

It is also possible to achieve a printing system such as the following.

A printing system comprises:

a printing apparatus; and a computer that is capable of communicating with the printing apparatus;

wherein the printing apparatus includes:

a movable print head for performing printing by forming dots on a medium;

a sensor for detecting an edge of the medium; and a controller for controlling operation of the print head and the sensor; and wherein the controller causes:

the print head to move by a first set amount from a reference position used when printing and print a first reference pattern on the medium;

the sensor to detect a position of an edge of the medium on the reference position side in the direction of movement of the print head; and the print head to move to a position that is apart by a second set amount from the position of the edge that has been detected and print a second reference pattern.

It is also possible to achieve a pattern for correction such as the following.

A pattern for correction, which is used with a printing apparatus for printing by forming dots on a medium using a movable print head and which is for setting a print start position of the print head, comprises:

a first reference pattern that is printed by the print head after the print head has been moved by a first set amount from a reference position used when printing; and a second reference pattern that is printed by the print head after the print head has been moved to a position that is apart by a second set amount from a position of an edge of the medium on the reference position side in the direction of movement of the print head.

It is also possible to achieve a printing apparatus such as the following.

A printing apparatus for printing target information on a medium by ejecting or sublimating ink to form dots, comprises:

first reference pattern printing means for printing a first reference pattern at a position on the medium that is apart by a predetermined set amount, in a main scanning direction, from a reference position used when printing;

detecting means for detecting an edge of the medium on the reference position side;

second reference pattern printing means for printing a second reference pattern at a position that is apart by a predetermined set amount using the edge that has been detected by the detecting means as a reference; and print start position correcting means for printing either one of the first or second reference pattern while suitably changing its set amount to correct a print start position in accordance with a correction amount that is determined according to a relationship between the first and second reference patterns.

Embodiments of the present invention are described below in greater detail with reference to the drawings.

Figure 2:
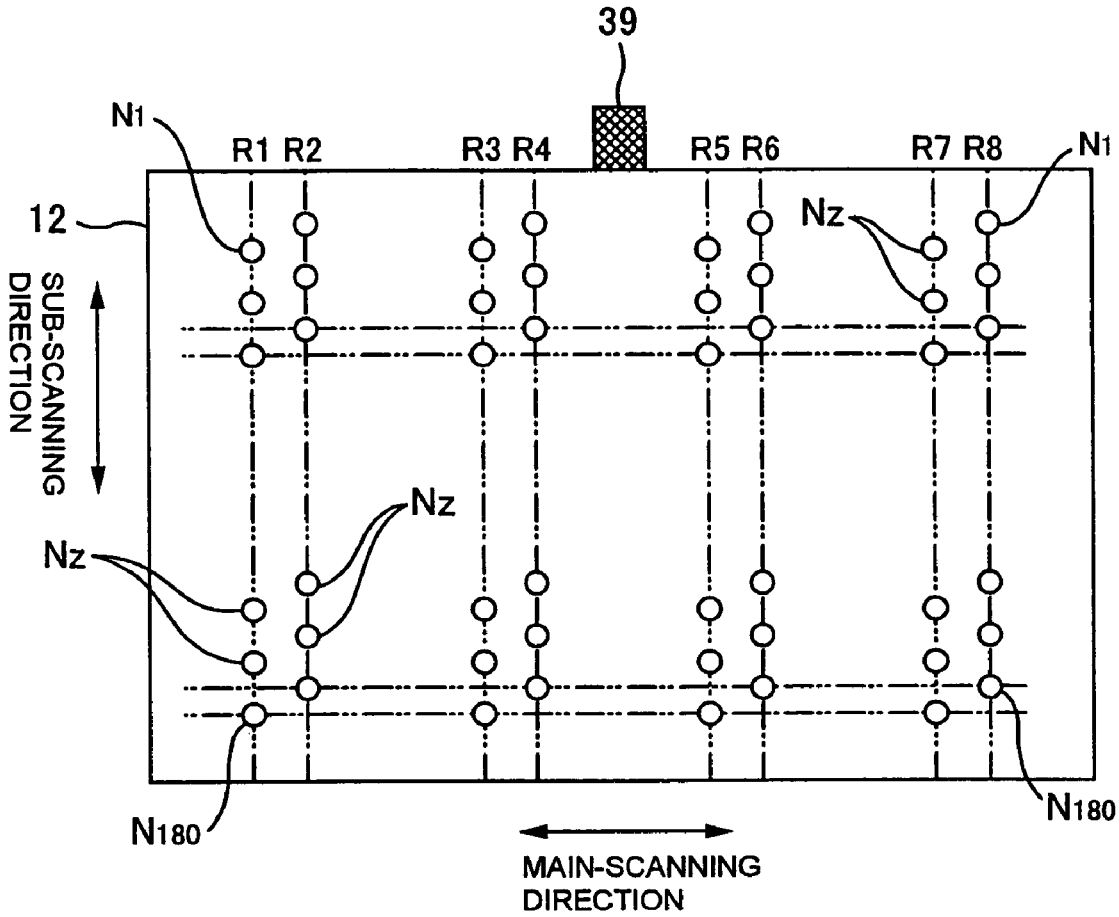
FIG. 2 is a diagram showing the arrangement of nozzles, nozzle rows, and an optical sensor in a print head used in the printer shown in FIG. 1.
Figure 3:
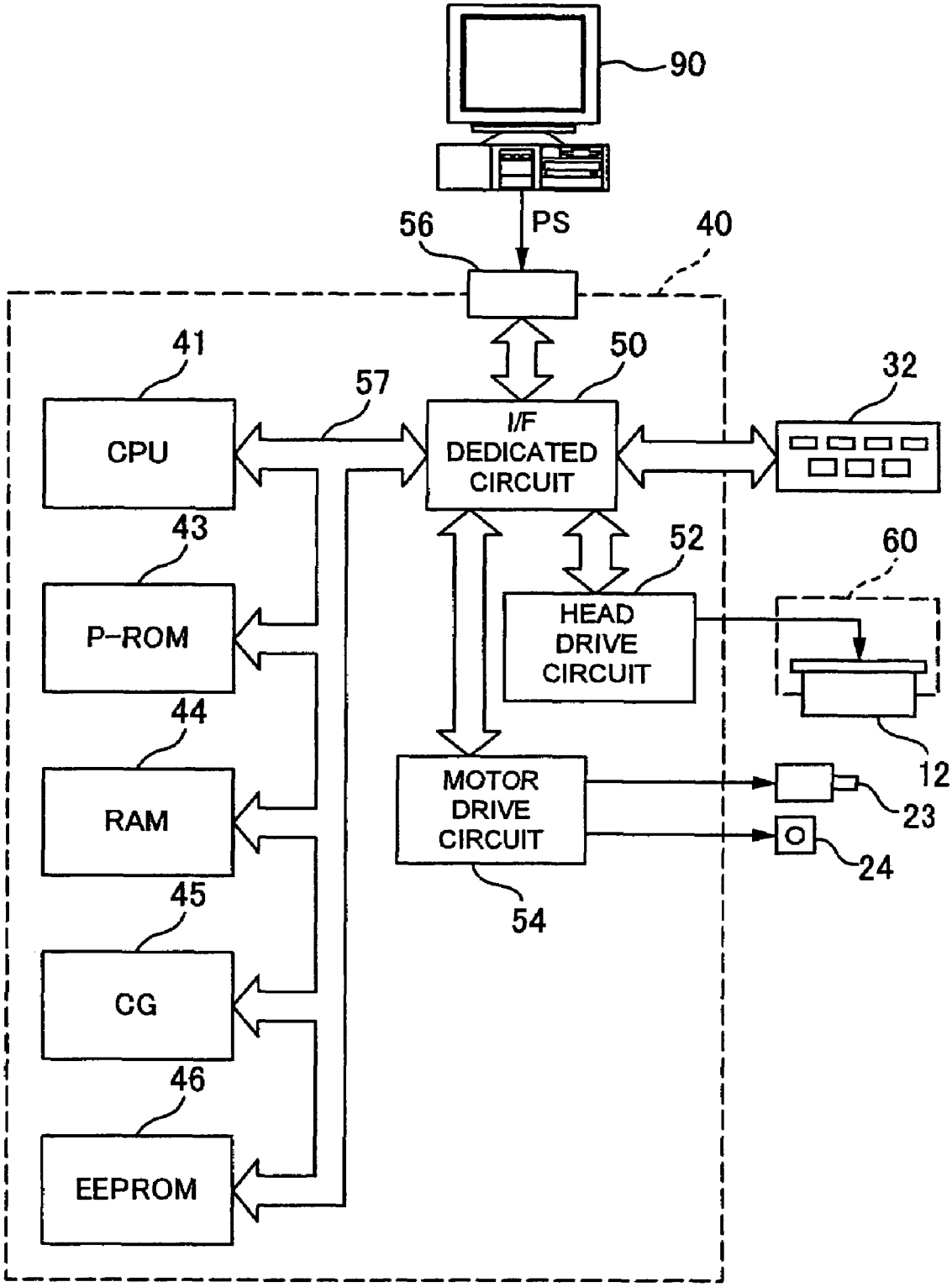
FIG. 3 is a block diagram showing the configuration of the printer, centered on a control circuit, in the computer system for printing that is shown in FIG. 1.

First, an overview of a printing apparatus and a printing system is provided with reference to FIG. 1 to FIG. 3. FIG. 1 is a structural diagram that schematically shows a printing system provided with an inkjet printer (hereinafter, shortened to "printer") 22, which is a printing apparatus, FIG. 2 is a diagram showing a detailed example of the structure of an ink head, and FIG. 3 is a block diagram showing an example of a structure of the printer 22, centered on a control circuit 40.

As shown in FIG. 1, the printer 22 has a sub-scan feed mechanism for carrying a print paper P with a paper feed motor 23, and a main-scan feed mechanism for moving a carriage 31, which is part of first reference pattern printing means and part of second reference pattern printing means, back and forth in the direction parallel to the axial direction of a paper feed roller 26 by a carriage motor 24. Here, the direction in which the print paper P is fed by the sub-scan feed mechanism is referred to as the sub-scanning direction, and the direction in which the carriage 31 is moved by the main-scan feed mechanism is referred to as the main-scanning direction.

The carriage motor 24 is made of a DC motor provided with an optical encoder. It should be noted that the carriage motor 24 alternatively can be a stepping motor that is not provided with an encoder or a stepping motor that is provided with an encoder. In addition to an optical encoder it is also possible to adopt a magnetic or other type of encoder.

Also, the printer 22 is provided with a print head unit 60, which is mounted to the carriage 31 and provided with a print head 12 that employs piezoelectric elements, a head drive mechanism for driving the print head unit 60 to control the ejection of ink and dot formation, and the control circuit 40 (one example of a controller) for sending and receiving signals to and from the paper feed motor 23, the carriage motor 24, the print head unit 60, and a control panel 32.

The control circuit 40, which is part of the first reference pattern printing means, part of the second reference pattern printing means, and also part of print start position correcting means, is connected to a computer 90 via a connector 56. The computer 90 is provided with a driver for the printer 22, and constitutes a user interface for receiving commands made by a user operating an input device such as a keyboard or a mouse, and for displaying various types of information in the printer 22 on a screen display of a display device 98 (see FIG. 4).

The sub-scan feed mechanism for carrying the print paper P is provided with a gear train (not shown) that transmits the rotation of the paper feed motor 23 to the paper feed roller 26 and a paper carry roller (not shown).

Further, the main-scan feed mechanism for moving the carriage 31 back and forth is provided with a slide shaft 34 which is arranged parallel to the shaft of the paper feed roller 26 and which slidably retains the carriage 31, a pulley 38, wherein an endless drive belt 36 is provided spanning between the pulley 38 and the carriage motor 24, and an optical sensor 39, which is a detection means for detecting the paper edge.

FIG. 2 is a diagram showing a detailed example of the structure of the print head 12 from the perspective of the print paper P. As shown in the figure, eight nozzle rows R1 to R8 are formed in the print head 12 side by side in the main scanning direction, each row being composed of 180 nozzles Nz arranged in a row in the sub-scanning direction. The nozzles Nz belonging to pairs of adjacent nozzle rows (for example, R1 and R2) of the eight nozzle rows R1 to R8 are misaligned with respect to one another by a predetermined pitch in the sub-scanning direction, and the nozzles Nz belonging to a pair consisting of every other nozzle row (for example, R1 and R3) are arranged at the same position in the sub-scanning direction.

In the print head 12 according to the present embodiment, the color of the ink that is supplied to each of the eight nozzle rows R1 to R8 changes from dark to light from the nozzle rows R4 and R5 positioned in the center of the print head 12 in the main scanning direction, which is perpendicular to the sub-scanning direction, toward the nozzle rows R1 and R8, which are positioned at the edge sections of the print head 12.

More specifically, black-based ink is ejected from the pair of adjacent nozzle rows R4 and R5 positioned in the center of the print head 12 in the main scanning direction. Cyan-based ink is ejected from the pair of nozzle rows R3 and R6 positioned outside of the nozzle rows R4 and R5, and magenta-based ink is ejected from the pair of nozzle rows R2 and R7 positioned outside of the nozzle rows R3 and R6. Furthermore, yellow-based ink is ejected from the pair of nozzle rows R1 and R8 positioned outside of and adjacent to the nozzle rows R2 and R7.

Here, the black-based ink is black ink (K), the cyan-based ink is cyan ink (C) or light cyan ink (LC), the magenta-based ink is magenta ink (M) or light magenta ink (LM), and the yellow-based ink is yellow ink (Y) or dark yellow ink (DY).

Further, the optical sensor 39 is provided on an upper portion of the print head 12. It should be noted that the positional relationship between the optical center of the optical sensor 39 and the nozzles is accurately known in advance, and there is very little variation among various apparatuses regarding this relationship.

As shown in FIG. 3, the control circuit 40 is constituted as an arithmetic and logic circuit that is provided with a CPU (Central Processing Unit) 41, a programmable ROM (P-ROM (Read Only Memory)) 43, a RAM (Random Access Memory) 44, a character generator (CG) 45 storing character dot matrix, and an EEPROM (Electronically Erasable and Programmable ROM) 46.

The control circuit 40 is further provided with an I/F dedicated circuit 50, which is an interface (I/F) between external motors and the control panel 32, for instance, a head drive circuit 52 connected to the I/F dedicated circuit 50 for driving the print head unit 60 and causing it to eject ink, and a motor drive circuit 54 for driving the paper feed motor 23 and the carriage motor 24.

The I/F dedicated circuit 50 is internally provided with a parallel interface circuit, and can receive print signals PS that are supplied from the computer 90 via the connector 56.

The control circuit 40, which serves as an example of the controller, controls the operations of the print head 12 and the optical sensor 39. As is discussed later, the control circuit 40 causes the print head 12 to move by a first set amount from a reference position used when printing and to print a first reference pattern on the medium, causes the optical sensor 39 to detect a position of an edge of the medium on the reference position side in the moving direction of the print head 12, and then causes the print head 12 to move to a position that is apart by a second set amount from the position of the edge that has been detected and to print a second reference pattern.

The configuration of the computer 90 is described next with reference to FIG. 4.

Figure 4:
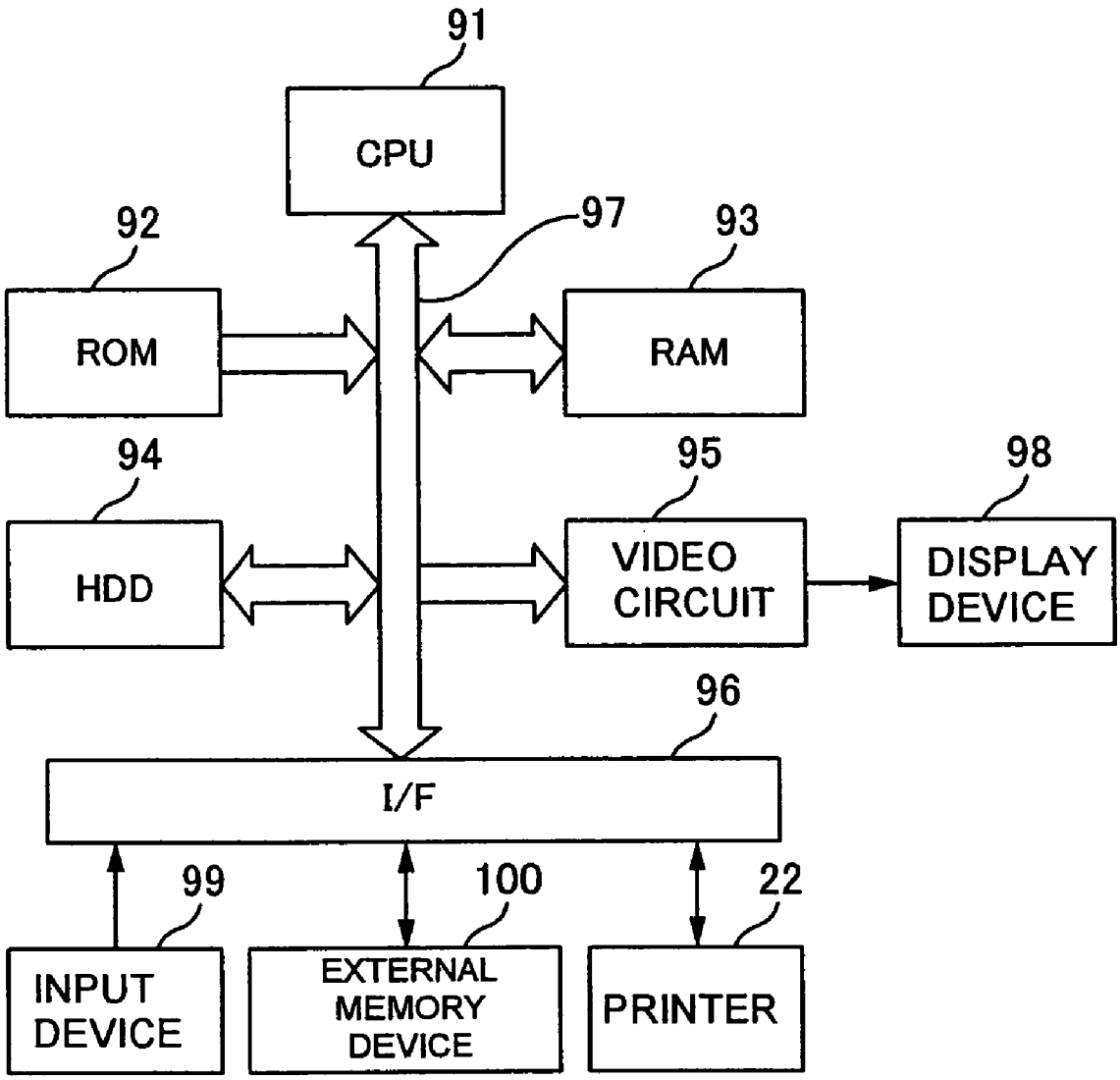
FIG. 4 is a block diagram showing a detailed configuration of the computer in the computer system for printing that is shown in FIG. 1.

As shown in FIG. 4, the computer 90 is made of a CPU 91, a ROM 92, a RAM 93, an HDD (Hard Disk Drive) 94, a video circuit 95, an I/F 96, a bus 97, a display device 98, an input device 99, and an external memory device 100.

Here, the CPU 91 is a controller for executing various computing processes in accordance with programs stored in the ROM 92 or the HDD 94, and controls the various sections of the apparatus.

The ROM 92 is a memory storing basic programs executed by the CPU 91 and data. The RAM 93 is a memory for temporarily storing, for example, programs being executed by the CPU 91 and data being computed.

The HDD 94 is a storage device for reading out data or programs stored on a hard disk, which is a storage medium, in accordance with requests from the CPU 91, and for storing data generated as the result of computer processing by the CPU 91 on the hard disk.

The video circuit 95 is a circuit for executing drawing processing in accordance with a draw command supplied from the CPU 91 and converting image data thus obtained into a video signal and outputting this signal to the display device 98.

The I/F 96 is a circuit for suitably converting the expression format of signals that are output from the input device 99 and the external memory device 100 and outputting a print signal PS to the printer 22.

The bus 97 is a signal line that connects the CPU 91, the ROM 92, the RAM 93, the HDD 94, the video circuit 95, and the I/F 96 to one another, allowing data to be sent and received between these.

The display device 98 is a device that is constituted by, for example, an LCD (Liquid Crystal Display) monitor or a CRT (Cathode Ray Tube) monitor, and that displays images corresponding to video signals output from the video circuit 95.

The input device 99 is a device that is constituted by, for example, a keyboard and a mouse, and that is for generating signals in accordance with operations performed by a user and supplying these to the I/F 96.

The external memory device 100 is a device that is constituted by, for example, a CD-ROM (Compact Disk-ROM) drive unit, an MO (Magneto Optic) drive unit, or an FDD (Flexible Disk Drive) unit, and that is for reading data and programs stored on CD-ROM disks, MO disks, or FDs and supplying these to the CPU 91. If the external memory device 100 is an MO drive unit or an FDD unit, then it also functions as a device for storing data supplied from the CPU 91 on an MO disk or an FD.

The operations of the printing apparatus and the computer program for printing according to the above embodiment are described next. First, a brief overview of the operation of the present embodiment is provided, and then the operation is described in detail.

Figure 5:
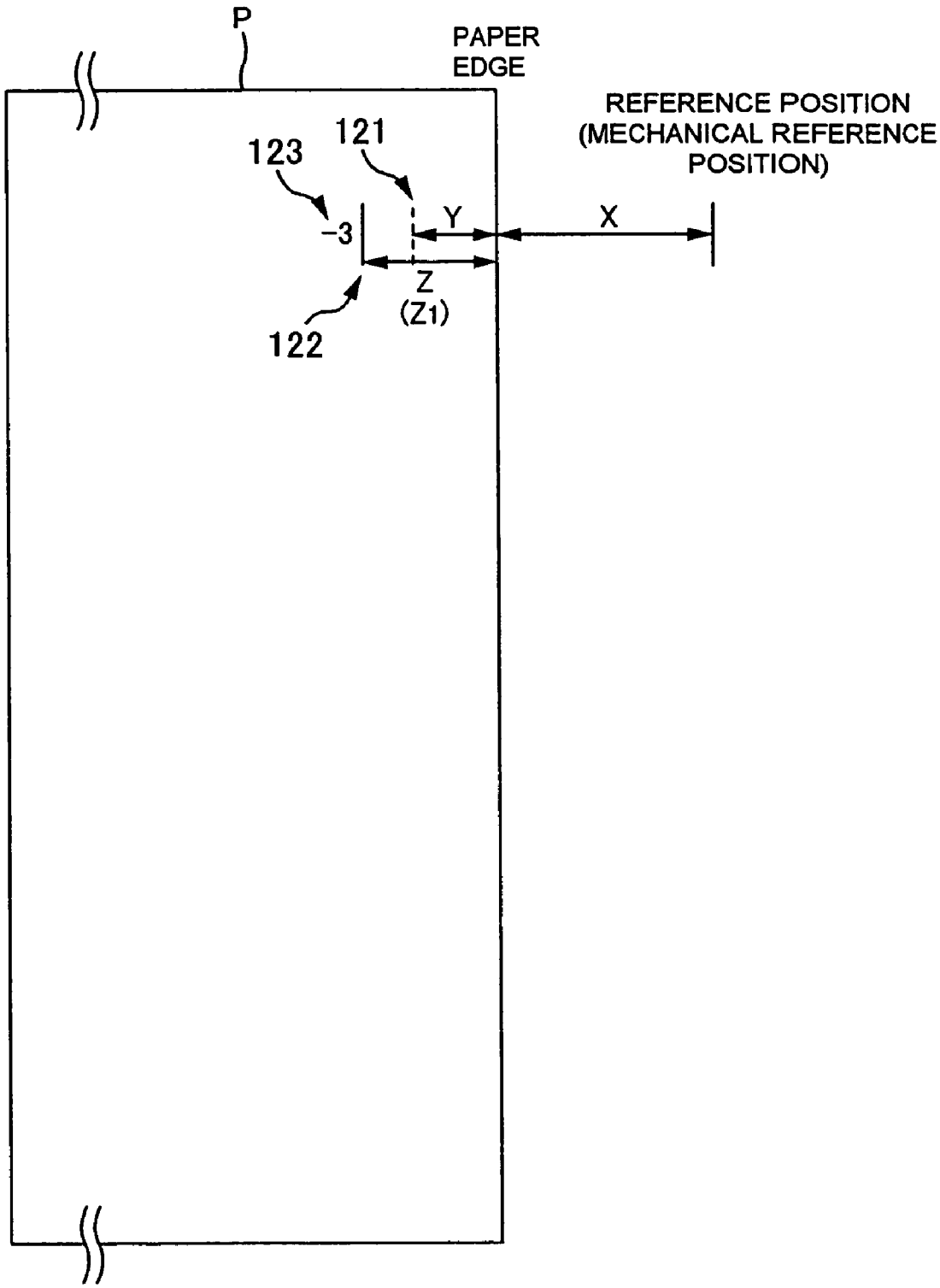
FIG. 5 is a diagram showing a positional relationship between a first reference line and a second reference line that are printed in accordance with the flowchart shown in FIG. 6.

As shown in FIG. 5, in printers, printing is typically executed with the assumption that a position located away from a reference position (mechanical reference position) by a predetermined distance (in this example, the distance corresponding to the variable X) is the paper edge. However, the position of the paper edge may be deviated from the assumed position due to, for example, an error of the paper feed mechanism or an error of a carrying mechanism for the carriage, and thus in so-called borderless printing, the image may be printed off of the print paper P or blank portions may be formed at edges of the print paper P. Accordingly, in the present embodiment, deviation of the print start position is corrected by accurately obtaining the value of the variable X mentioned above using a pattern for correction.

Figure 6:
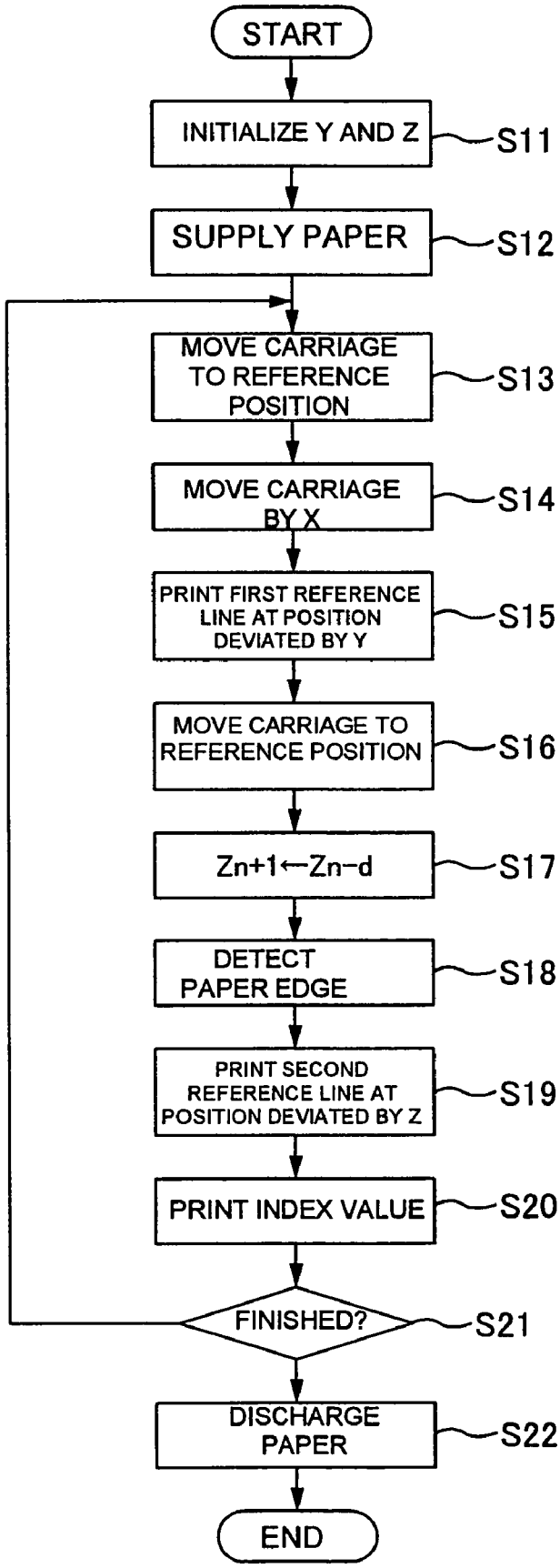
FIG. 6 is a flowchart describing a flow of operations when printing a pattern for correction with the printer shown in FIG. 1.

An explanation of the detailed operation of the present embodiment is provided below with reference to the flow chart shown in FIG. 6.

First, a person making the adjustment (for example, an operator during the manufacturing process or a user) operates the input device 99 of the computer 90 to give a command to start an application program for adjusting the print start position, and then the CPU 91 of the computer 90 reads out and executes the application program for adjusting the print start position from the HDD 94. As a result, first, a process for printing a correction pattern for adjusting the print start position, that is, a process such as that shown in FIG. 6, is executed. When the procedure of the flowchart is started, the following steps are performed.

In Step S11, the CPU 91 of the computer 90 initializes a variable Y (see FIG. 5) used when printing a first reference line (which is an example of the first reference pattern) and a variable Z (see FIG. 5) used when printing a second reference line (which is an example of the second reference pattern). More specifically, for example, the variable Y is assigned a value that corresponds to a distance of 5 mm, and the variable Z is assigned a value that corresponds to a distance (=7 mm) obtained by adding a predetermined distance (for example, 2 mm) to the distance of 5 mm. It should be noted that the value of X corresponding to the distance from the reference position to the paper edge (for example, 20 mm) is stored in the EEPROM 46 in advance as a set value. Here, X is the logic value of the design, and is not the actual distance to the paper edge. Further, the values of the variable Y and the variable Z are preferably as small as possible in order to reduce the impact of error. However, taking mechanical error into account, they are preferably at least 3 mm. Therefore, the variable Y is preferably in a range from 3 mm to 6 mm, and the variable Z is preferably in a range from 0.1 mm to 9.0 mm.

In Step S12, the CPU 91 of the computer 90 sends a command to the printer 22 to supply paper. As a result, the CPU 41 of the printer 22 carries out the supply of paper by rotating a paper supply roller, which is not shown, to draw out a single sheet of print paper P.

In Step S13, the CPU 91 of the computer 90 sends a command to the printer 22 to move the carriage 31 to the reference position (mechanical reference position). As a result, the CPU 41 of the printer 22 drives the carriage motor 24 to move the carriage 31 to the right end in FIG. 1. This position corresponds to the reference position of FIG. 5.

In Step S14, the CPU 91 of the computer 90 sends a command to the printer 22 to move the carriage 31 from the reference position by a distance corresponding to the variable X. As a result, the CPU 41 of the printer 22 reads the value of the variable X stored in the EEPROM 46 and moves the carriage 31 from the reference position by a predetermined distance that corresponds to this value.

In Step S15, the CPU 91 of the computer 90 sends a command to the printer 22 to print a first reference line at a position deviated from the position after the movement in Step 14, which is taken as the reference, by a distance corresponding to the variable Y. As a result, the CPU 41 of the printer 22 prints a first reference line by causing black (K) ink to be ejected from nozzles $N_{47}$ to $N_{134}$ of either one or both of the nozzle rows R4 and R5, for example, to a position apart from the position after the movement in Step 14, which is taken as the reference, by a predetermined distance corresponding to the variable Y. FIG. 5 shows the first reference line 121 that is printed at this time.

As shown in FIG. 5, the first reference line 121 is printed at a position that is apart from the reference position (mechanical reference position) by a predetermined distance corresponding to the variable X and by a predetermined distance corresponding to the variable Y. It should be noted that in this example, the position located away from the reference position by a predetermined distance corresponding to the variable X matches the edge of the print paper P, but in practice there are instances in which they do not match due to error, and therefore, as discussed above, in the present embodiment adjustment is performed for the purpose of matching them.

In Step S16, the CPU 91 of the computer 90 sends a command to the printer 22 to move (return) the carriage 31 to the reference position. As a result, the CPU 41 of the printer 22 drives the carriage motor 24 to move the carriage 31 to the reference position.

In Step S17, the CPU 91 of the computer 90 subtracts the value d from the variable Z. More specifically, since a predetermined initial value (for example, a value corresponding to 7 mm) is stored as the variable Z, if this variable is regarded as $Z_0$, then the value d (for example, a value corresponding to 1/1440 inch), which serves as the amount of deviation, is subtracted from this value ($Z_0$) to obtain a value $Z_1$ (=a value corresponding to (7 mm−1/1440 inch)), and this is stored as the new variable Z. It should be noted that it is also possible for the value d to be set as a predetermined initial value in Step S11 like the variables Y, and Z. That is, the value d can be provided as a variable that can be freely changed or set by the user, for instance.

In Step S18, the CPU 91 of the computer 90 sends a command to the printer 22 to detect the paper edge. As a result, the CPU 41 of the printer 22 drives the carriage motor 24 to move the carriage 31 from the reference position to the left, and refers to the output from the optical sensor 39 to detect the paper edge.

In Step S19, the CPU 91 of the computer 90 sends a command to the printer 22 to print a second reference line 122 (see FIG. 5) at a position that is apart from the paper edge by a distance that corresponds to $Z_1$, which is the new variable Z. As a result, the CPU 41 of the printer 22 makes the second reference line 122 be printed at a position apart from the detected paper edge by a distance that corresponds to the new variable Z (more specifically, $Z_1$) by causing the nozzles $N_{47}$ to $N_{134}$ of the nozzle rows R4 and R5 to eject black (K) ink. FIG. 5 shows the second reference line 122 that is printed at this time. As shown in the figure, the second reference line 122 is printed at a position that is apart from the paper edge by a distance that corresponds to the variable $Z_1$.

In Step S20, the CPU 91 of the computer 90 sends a command to the printer 22 to print an index value. As a result, the CPU 41 of the printer 22 makes a predetermined index value be printed to the left of the second reference line 122. FIG. 5 shows an index value 123 that is printed at this time. In the example of this figure, "−3" is printed as the index value. It should be noted that this index value is utilized when finding the correction amount for the print start position, as will be discussed later.

In Step S21, the CPU 91 of the computer 90 determines whether or not to end the process, and if the process is to be ended, then the procedure is advanced to Step S22, and if not, then the procedure is returned to Step S13 and the same process is repeated. As a result, the first reference line 121 is printed at the same position as in the case described above, and the second reference line 122 is printed at a position that corresponds to the value of the variable Z ($Z_1$, $Z_2$, $Z_3$, . . . ) gradually decreased by the value d, and index values are printed for each reference line.

In Step S22, if it is determined that the procedure is to be ended, then the CPU 91 of the computer 90 sends a command to the printer 22 to discharge the paper. As a result, the CPU 41 of the printer 22 drives the paper feed roller 26 and a paper discharge roller that is not shown to discharge the print paper P.

Figure 7:
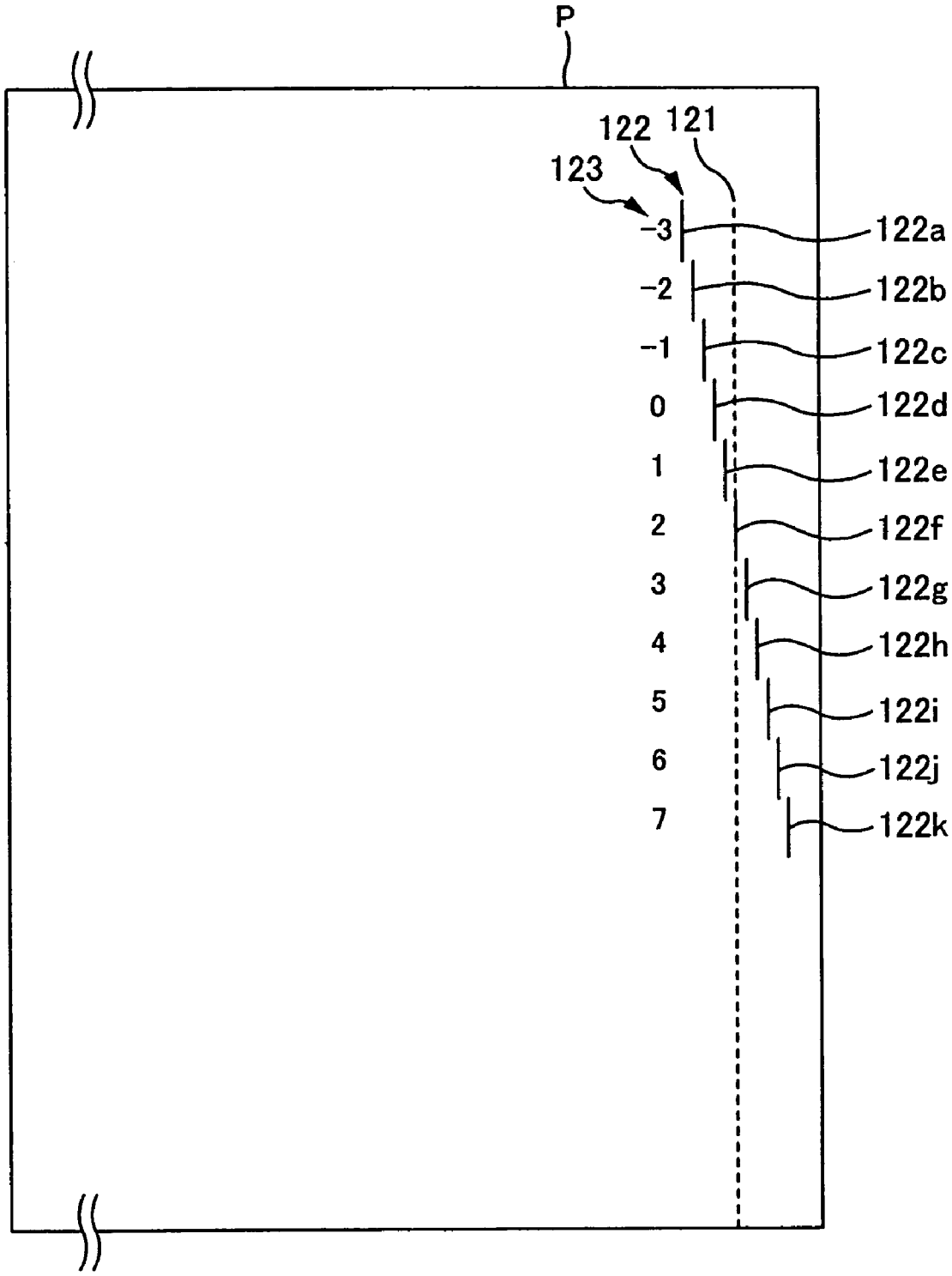
FIG. 7 is a diagram showing an example of a pattern for correction that is printed in accordance with the flowchart shown in FIG. 6.

FIG. 7 is a diagram showing an example of the pattern obtained through the above process. In this example, the first reference line 121, which is shown by a dashed line, is printed on the right end of the print paper P. A plurality of second reference lines 122 (second reference lines 122*a* to 122*k*) are printed such that they cross the first reference line 121 from the left to right, and the second reference lines 122*b* to 122*k* are printed deviated respectively from the second reference lines 122*a* to 122*j* positioned directly above each of them by a distance that corresponds to the value d, which is the fixed value discussed above. For example, the second reference line 122*a* and the second reference line 122*b* are deviated from one another by a distance that corresponds to the value stored as the value d, which becomes the amount of deviation. Further, index values "−3" to "7" are printed respectively to the left of the second reference lines 122*a* to 122*k*. It should be noted that in this example, the first reference line 121 is shown by a dashed line, but this is only in order to distinguish it from the second reference lines 122, and in practice it can also be printed as a solid line instead of a dashed line.

Next, the print start position is adjusted by calibrating the distance X with reference to the second reference lines 122. More specifically, in the pattern shown in FIG. 7, the second reference line that is closest to the first reference line 121 is selected from among the second reference lines 122*a* to 122*k*. In the example of this figure, the second reference line 122*f*, whose index value is "2," matches the first reference line 121.

Here, the second reference line 122*d*, whose index value is "0," is set such that Z=Y. That is, it is set such that the distance from the edge of the print paper P to the second reference line 122*d* is equal to Y (for example, 5 mm). The second reference line 122*d* is printed at a position that is apart from the detected paper edge by the value of Y (for example, 5 mm), and thus the second reference line 122*d* is apart from the paper edge by the correct value Y (for example, 5 mm). Therefore, if the value of the variable X corresponds to the distance from the reference position to the paper edge, then the second reference line 122*d*, whose index value is "0," should match the first reference line 121. On the other hand, if any other second reference line 122 matches the first reference line 121, then this is an indication that the value of the variable X, which is the value of the design, does not correspond to the distance from the reference position to the paper edge.

The example of FIG. 7 shows that the actual distance between the reference position and the paper edge is greater than the value of X. Therefore, the second reference line 122*d* with an index value of "0" is printed to the left of the first reference line 121, whose logic value is derived from the addition of X and Y.

When selection of the closest second reference line 122 is complete, then the application program of the computer 90 sends a command to prompt input of the index value of the second reference line 122 that is closest to (or matching) the first reference line 121. As a result, the input device 99 is operated to input the index value "2", and then the computer 90 transfers the index value "2" to the printer 22 via the I/F 96.

In the printer 22, the CPU 41 receives the index value that is transferred from the computer 90 and adds a predetermined value that corresponds to the index value that has been obtained to the value indicating the print start position that is stored in the EEPROM 46. For example, in the current example, a predetermined value corresponding to the index value "2" (=2×1/1440 inch) is added. The result is that the print start position is shifted to the left by 2/1440 inch.

When setting of the EEPROM 46 is complete, the computer 90 controls the printer 22 such that it prints the same correction pattern once again. As a result, the printer 22 prints the same correction pattern as in FIG. 7 using the value of the variable X that has been reset (the value obtained by adding 2*d* to the initially set value of X). The value of the variable X that has been reset is a value obtained by adding 2*d* to the initially set variable X, and thus the first reference line 121 is printed at a position that is shifted to the left by 2*d* compared to the pattern shown in FIG. 7.

As a result, in the correction pattern that is printed anew, the second reference line 122*d*, whose index value is "0," becomes closest to the first reference value 121, and this indicates that the print start position has been adequately adjusted, and thus the process is ended. On the other hand, if the second reference line 122*d* and the first reference line 121 do not match, then the print start position is regarded as improper, and the same correction pattern as that shown in FIG. 7 is printed again to adjust the print start position.

By repeatedly performing this process, the value indicating the print start position that is stored in the EEPROM 46 is adjusted to an appropriate value, and thus, for example, even if borderless printing is performed, it is possible to prevent blank areas from appearing on the paper edge and to prevent the image from being printed off of the print paper P.

Figure 8:
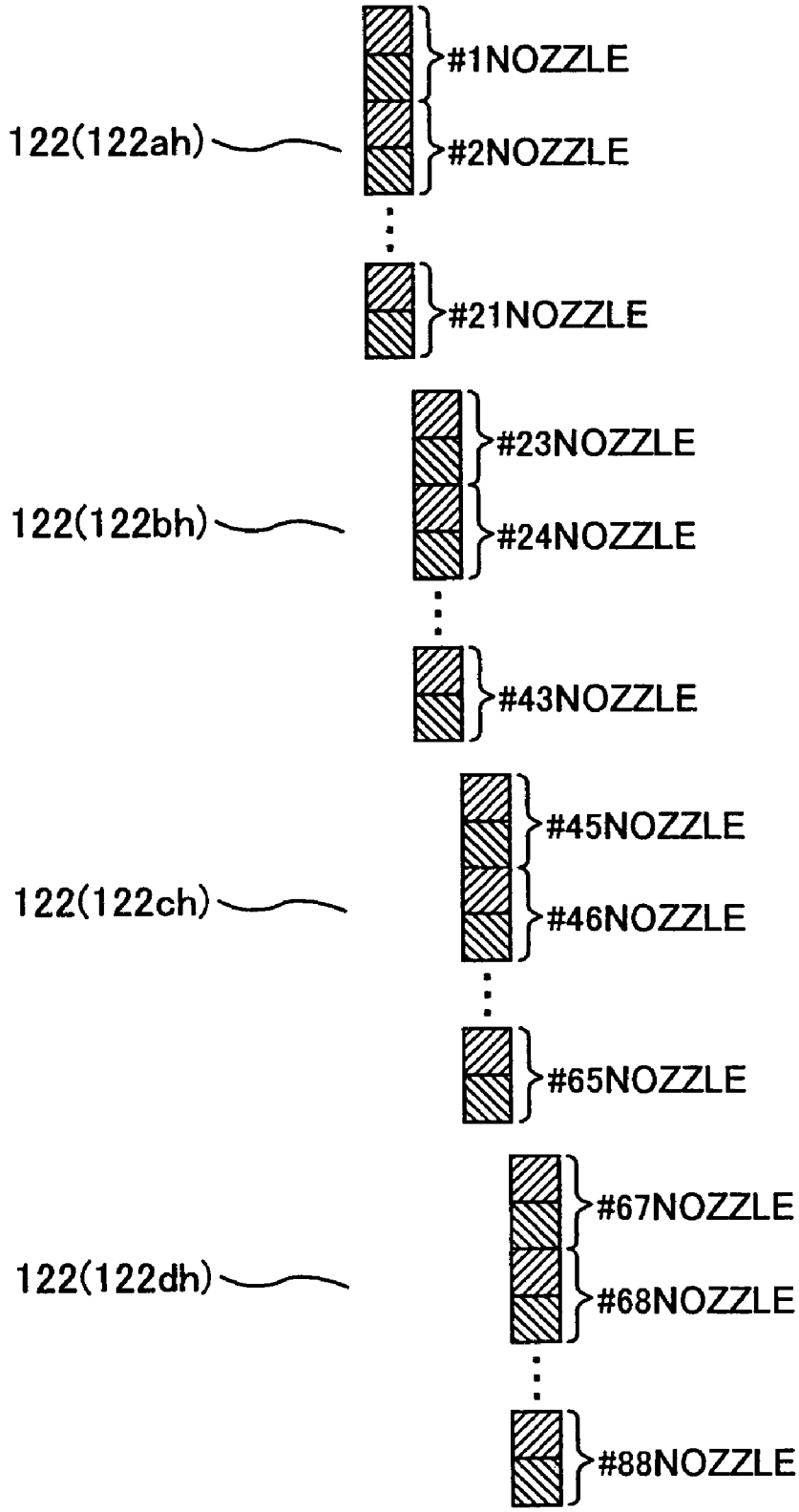
FIG. 8 is a diagram for describing an example of another method for printing a pattern for correction.

It should be noted that in the foregoing embodiment, one of the second reference lines 122*a* to 122*k* is printed every time the carriage 31 is moved from the reference position until it returns to the reference position again, but it is also possible to print a plurality of the second reference lines 122 at one time. FIG. 8 shows an example of a case where four of the second reference lines 122 are printed at one time. In this example, four of the second reference lines 122 are printed in a single scan by the nozzles #1 to #88. Also, as shown in FIG. 2, in this example the second reference lines 122 are printed by combining two nozzle rows (for example, nozzle row R4 and nozzle row R5 shown in FIG. 2) that are vertically misaligned with respect to one another.

That is, the second reference lines 122 are each printed using a total of 42 nozzles. For example, the second reference line 122*ah* positioned at the top is printed using nozzles #1 to #21, which are two groups of nozzle rows vertically misaligned with respect to one another. It should be noted that nozzles #1 to #88 can be, for example, the nozzles $N_1$ to $N_{88}$ as shown in FIG. 2, or alternatively can be the nozzles $N_{47}$ to $N_{134}$ positioned in the central section.

In this way, by simultaneously printing a plurality of the second reference lines 122, it is possible to shorten the time required for printing the correction pattern. Also, by using two groups of nozzle rows that are misaligned with respect to one another, it is possible to raise the ink density per unit area, make the pattern more visibly discernable, and print at a faster speed.

It should be noted that in the above example, four of the second reference lines 122 were printed at once, but it is also possible to print a number of lines other than this (for example, two lines, three lines, or five lines or more) at once. It is also possible to use various nozzle row combinations other than R4 and R5.

As described above, with this embodiment of the present invention, a first reference line 121, which takes the reference position as its reference, and a plurality of second reference lines 122, which take the paper edge as their reference and whose positions are deviated with respect to one another by a set spacing, are printed, and by referencing these reference lines 121 and 122, the print start position is calibrated, and thus, for example, even if performing so-called borderless printing, non-printed areas can be prevented from being left on the print paper P.

An embodiment of the present invention was described above, but it is possible to perform various alterations to the present invention. For example, in the above embodiment, the first and the second reference lines 121 and 122 were configured as lines with a one dot width, but for example, it is also possible to adopt a configuration in which each reference line is a line having a width of a plurality of dots (for example, 20 dots) and the second reference line of the plurality of second reference lines that is nearest the second reference line is selected. Adopting such a configuration allows thick reference lines to be formed, and this allows the ability to visibly discern the lines to be increased.

Further, in the above embodiment, the nozzle rows R4 and R5, which eject black ink, are used to print the first and the second reference lines 121 and 122, but it is also possible to print these lines using other nozzle rows. For example, it is also possible to use nozzle rows other than R4 and R5 that have the same color or to use nozzle rows having different colors.

Further, in the above embodiment, after the first reference line 121 is printed, the carriage is moved to the reference position and the second reference lines 122 are printed. That is, the two reference lines 121 and 122 are printed over two back-and-forth movements of the carriage. However, it is also possible to print the two reference lines 121 and 122 in a single back-and-forth operation. That is, it is also possible to print the first reference line 121 from the variable X and the variable Y, and detect the paper edge in that pass, and print the second reference lines 122.

Also, in the above embodiment, the paper edge is detected by the optical sensor 39, and using this as a reference the second reference lines 122 are printed, but in the present invention, it is also possible to use various types of sensors other than the optical sensor 39. For example, it is also possible to use an electrostatic sensor or a contact-type sensor.

Further, in the above embodiment, the second reference lines 122 corresponding to the index values "−3" to "7" are printed, but it is also possible to print the second reference lines 122 corresponding to a range other than this. It is also possible to change the range of the index values that are printed between those during the first printing and those in subsequent printings. For example, index values from "−3" to "7" can be printed as in the case discussed above in the first printing, and index values such as from "−2" to "2" can be printed in the second and subsequent printings. By doing this, it is possible to shorten the time required for the second and subsequent printings.

Further, in the above embodiment, a single second reference line closest to the first reference line is selected and its index value is input, but it is also possible to adopt a configuration in which an intermediate value between index values is input. For example, if an intermediate position between an index value of "2" and an index value of "3" is considered the most appropriate value, then the number "2.5" can be input.

Further, in the above embodiments, the first reference line 121 is formed as a single straight line and the second reference lines 122 are formed as a plurality of lines that are printed each slightly misaligned with each other, but it is also possible to print, for example, only one long second reference line 122*d,* whose index value is "0", as the second reference lines 122 and to print a plurality of first reference lines 121 each slightly misaligned with each other. That is, it is also possible to set the variable X such that $X_n-d=X_{n+1}$ (or $X_n+d=X_{n+1}$) or to set the variable Y such that $Y_n-d=Y_{n+1}$(or $Y_n+d=Y_{n+1}$).

Further, in the above embodiment, a plurality of second reference lines 122 are printed on a single sheet of print paper P, but it is also possible to print a single reference line 121 and a single second reference line 122 on one sheet of print paper P and print them such that either one of the second reference line 122 or the first reference line 121 on each print paper P is printed at a position that is slightly deviated from that of the previous sheet.

Further, as mentioned above, a printer 22 provided with a head that ejects ink using piezoelectric elements is used, but various elements other than piezoelectric elements can be used as the ejection driving elements. For example, the present invention can also be adopted for a printer that is provided with ejection driving elements of a type which eject ink by passing a current through a heater arranged on the ink path to generate bubbles within the ink path.

Also, any configuration can be adopted for the control circuit 40 as long as it supplies drive signals to the ejection driving elements and generates drive signals such that the sequential ejection order of the ink can be kept identical in the forward and return passes of the main scan.

Furthermore, in the above embodiment, an application program for printing the pattern for correction is stored in the HDD 94 (or the external memory device 100) and the printer 22 prints the pattern for correction in accordance with commands from this application program, but it is also possible to store an application program having an equal function in the P-ROM 43 of the printer 22, and for the application program to be activated to print the pattern for correction when the control panel 32 has been operated with a predetermined procedure. In other words, it is only necessary that the application program is stored in either the computer 90 or the printer 22 and that the application program is activated and run by either the computer 90 or the printer 22 when printing a pattern for correction.

It should be noted that the above print-processing functions can be achieved by only a computer. In such a case, the computer is provided with a program in which the processing contents of functions that should be present in the printing apparatus is described. By executing this program on the computer, the above-described print-processing functions are achieved on the computer. The program in which the processing contents are described can be stored in a computer-readable storage medium. Examples of a computer-readable storage medium include magnetic storage devices, optical disks, magneto optic storage media, and semiconductor memories. Examples of magnetic storage devices include hard disk drives (HDD), flexible disks (FD), and magnetic tapes. Examples of optical disks include DVDs (Digital Versatile Disks), DVD-RAMs (Random Access Memory), CD-ROMs, and CD-Rs (Recordable)/RWs (Rewritable). Examples of magneto optic storage media include MOs.

If the program is to be distributed, then, for example, transportable storage media such as DVDs or CD-ROMs storing the program are sold commercially. It is also possible to store the program on the memory device of a server computer and to transfer the program from the server computer to other computers over a network.

A computer for executing the program stores, for example, the program that is stored on a transportable storage medium or the program that is transferred from the server computer on its own memory device. Then, the computer reads the program from its own memory device and executes the processing according to the program. It should be noted that it is also possible for the computer to directly read the program from the transportable storage medium and to execute processing according to the program. It is also possible for the computer to successively execute the processes according to the obtained program each time the program is transferred from the server computer.

With the present embodiment, it is possible to reliably and quickly adjust the print start position.

What is claimed is:

1. A printing method for printing by forming dots on a medium using a movable print head, comprising:

a step of moving said print head by a first set amount from a reference position used when printing and printing a first reference pattern on said medium;

a step of returning said print head to the reference position after printing said first reference pattern;

a step of detecting a position of an edge of said medium disposed towards the reference position in the direction of movement of said print head; and a step of moving said print head from the reference position to a position that is apart by a second set amount from said position of the edge that has been detected and printing a second reference pattern.

2. A printing method according to claim 1, wherein:

said print head prints target information on the medium by forming dots by ejecting or sublimating ink; and a print start position of said print head is corrected in accordance with a correction amount that is determined according to a relationship between said first reference pattern and said second reference pattern.

3. A printing method according to claim 1, wherein said first reference pattern and said second reference pattern, printed while suitably changing either one of said first set amount or said second set amount, have a plurality of line segments with different positions on the medium.

4. A printing method according to claim 3, wherein a print start position of said print head is corrected in accordance with a set amount of a line segment, among said plurality of line segments of one of said first and second reference patterns, that is closest to the other reference pattern of said first and second reference patterns.

5. A printing method according to claim 3, wherein one or more line segments, among the lines configuring said plurality of line segments, is printed in a single movement of said print head.

6. A printing method according to claim 1, wherein:

an edge of said medium is detected by an optical sensor; and said print head prints said second reference pattern using the edge of said medium that has been detected by said optical sensor as a reference.

7. A printing method according to claim 1, wherein either one of said first reference pattern or said second reference pattern is printed while suitably changing either one of said first set amount or said second set amount.

8. A first computer-readable medium comprising the following codes:

a code for moving a movable print head by a first set amount from a reference position used when printing and printing a first reference pattern on a second medium;

a code for returning said print head to the reference position after printing said first reference pattern;

a code for detecting a position of an edge of the second medium disposed towards the reference position in the direction of movement of said print head; and a code for moving said print head from the reference position to a position that is apart by a second set amount from said position of the edge that has been detected and printing a second reference pattern.

9. A printing apparatus comprising:

a movable print head for performing printing by forming dots on a medium;

a sensor for detecting an edge of the medium; and a controller for controlling operation of said print head and said sensor;

wherein said controller causes:

said print head to move by a first set amount from a reference position used when printing and print a first reference pattern on the medium;

said print head to move to the reference position after printing said first reference pattern;

said sensor to detect a position of an edge of the medium on said reference position side in the direction of movement of said print head; and said print head to move the reference position to a position that is apart by a second set amount from said position of the edge that has been detected and print a second reference pattern.

10. A printing system comprising:

a printing apparatus; and a computer that is capable of communicating with said printing apparatus;

wherein said printing apparatus includes:

a movable print head for performing printing by forming dots on a medium;

a sensor for detecting an edge of the medium; and a controller for controlling operation of said print head and said sensor; and wherein said controller causes:

said print head to move by a first set amount from a reference position used when printing and print a first reference pattern on the medium;

said print head to move to the reference position after printing said first reference pattern;

said sensor to detect a position of an edge of the medium disposed towards the reference position in the direction of movement of said print head; and said print head to move from the reference position to a position that is apart by a second set amount from said position of the edge that has been detected and print a second reference pattern.

11. A pattern for correction, which is printed by a printing apparatus comprising a print head for performing printing and which is for setting a print start position of said print head, comprising:

a first reference pattern that is printed by said print head of said printing apparatus after said print head has been moved by a first set amount from a reference position used when printing; and a second reference pattern that is printed by said print head of said printing apparatus with a plurality of nozzles that are arranged along a direction in which said medium is fed after said print head has been moved to the reference position after printing said first reference pattern, and has been moved from the reference position to a position that is apart by a second set amount from a position of an edge of the medium disposed towards the reference position in the direction of movement of said print head.

12. A printing apparatus for printing target information on a medium by ejecting or sublimating ink to form dots, comprising:

first reference pattern printing means for printing a first reference pattern at a first position on said medium that is apart by a predetermined set amount, in a main scanning direction, from a reference position used when printing;

detecting means for detecting an edge of said medium disposed towards the reference position;

second reference pattern printing means for printing a second reference pattern with a plurality of nozzles that are arranged along a direction in which said medium is fed at a second position that is apart by a predetermined set amount using the edge that has been detected by said detecting means as a reference, after said first reference pattern has been printed, said nozzles have been moved to the reference position, and said nozzles have been moved from the reference position to said second position; and print start position correcting means for printing either one of said first or second reference pattern while suitably changing its set amount to correct a print start position in accordance with a correction amount that is determined according to a relationship between said first and second reference patterns.

* * * * *